US009445677B2

(12) United States Patent
Brown

(10) Patent No.: US 9,445,677 B2
(45) Date of Patent: Sep. 20, 2016

(54) LEAKPROOF COVER FOR COMBINED POURING AND VENTING CONTAINER CLOSURE

(71) Applicant: Craig E. Brown, Chesterfield, MO (US)

(72) Inventor: Craig E. Brown, Chesterfield, MO (US)

(73) Assignee: New Vent Designs, Inc., Chesterfield, MO (US)

( * ) Notice: Subject to any disclaimer, the term of this patent is extended or adjusted under 35 U.S.C. 154(b) by 50 days.

(21) Appl. No.: 14/544,647

(22) Filed: Jan. 29, 2015

(65) Prior Publication Data

US 2015/0238030 A1 Aug. 27, 2015

Related U.S. Application Data

(60) Provisional application No. 61/966,651, filed on Feb. 27, 2014.

(51) Int. Cl.
*A47G 19/22* (2006.01)
*B65D 47/08* (2006.01)

(52) U.S. Cl.
CPC ..... *A47G 19/2266* (2013.01); *A47G 19/2272* (2013.01); *B65D 47/08* (2013.01)

(58) Field of Classification Search
USPC ..... 220/368, 367.1, 715, 254.3, 254.6, 220/254.1, 259.2, 817, 825, 826, 818, 819, 220/844, 843, 836, 810, 263, 714, 303; 222/546, 556, 557; 215/235, 237, 238, 215/239, 240, 242, 311, 307, 280, 281, 284, 215/153.14, 11.4
See application file for complete search history.

(56) References Cited

U.S. PATENT DOCUMENTS 485,173 A * 11/1892 Finley ..... B65D 23/104 215/242
749,060 A * 1/1904 Hentgen ..... B65D 45/24 215/239
789,230 A * 5/1905 Peacock ..... B65D 47/40 222/111
1,363,983 A * 12/1920 Knudsen ..... B65D 39/16 215/235
1,479,053 A * 1/1924 Brooks ..... F16J 13/20 220/200
2,143,250 A * 1/1939 Ritter ..... B65D 47/249 222/482
2,495,884 A * 1/1950 Beyers ..... B65D 47/088 222/545
2,788,914 A * 4/1957 Todt ..... F16J 13/20 220/259.2

(Continued)

*Primary Examiner* — J. Gregory Pickett
*Assistant Examiner* — Gideon Weinerth
(74) *Attorney, Agent, or Firm* — Paul M. Denk

(57) ABSTRACT

A leakproof cover for combined pouring and venting container closure is disclosed which comprises a cap having an outer surface and an inner surface, a first arm having an aperture, a latch, a projection, a stop member extending downwardly from the inner surface, and a second arm extending downwardly from the inner surface with the second arm having an aperture, a closure device having a threaded rim, a vent, a spout; a pair of arms each having an aperture therein, a first pin for insertion through the apertures in the pair of arms and the aperture in the first arm of the cap for connecting the cap to the closure device, a spout seal device having a pair of arms each having an aperture, an upper member having a pair of depending legs with the upper member and the legs for covering the spout, the upper member having a rubber insert that provides a seal between the spout and the spout seal device to prevent any liquid from leaking out of the spout, and a second pin for insertion through the apertures in the pair of arms of the spout seal device and the aperture in the second arm for connecting the spout seal device to the cap.

16 Claims, 2 Drawing Sheets

(56) References Cited

U.S. PATENT DOCUMENTS 2,889,966 A * 6/1959 Burt ..... G01F 11/28 222/445
3,419,187 A * 12/1968 Bazarnic ..... B65D 47/249 222/153.05
3,655,102 A * 4/1972 Moran ..... B65D 47/148 215/309
3,799,408 A * 3/1974 Palmer ..... B65D 45/025 222/474
3,848,774 A * 11/1974 Schimke ..... G01F 11/32 222/36
4,009,794 A * 3/1977 Zapp ..... B65D 45/06 215/210
4,119,238 A * 10/1978 Ali Ja'afar ..... F16J 13/18 220/211
4,742,928 A * 5/1988 Braun ..... B65D 47/0885 215/235
4,756,442 A 7/1988 Halm et al.
4,782,985 A * 11/1988 Kinsley ..... B65D 47/0814 222/481.5
5,289,930 A * 3/1994 Inouye ..... B65D 83/00 206/223
5,570,796 A 11/1996 Brown et al.
5,779,071 A 7/1998 Brown et al.
2003/0010742 A1* 1/2003 Kobilan ..... B43K 23/12 215/235
2014/0034644 A1* 2/2014 Wahl ..... B65D 43/16 220/254.6
2014/0217128 A1* 8/2014 Samartgis ..... B65D 47/12 222/472

* cited by examiner

LEAKPROOF COVER FOR COMBINED POURING AND VENTING CONTAINER CLOSURE

CROSS REFERENCE TO RELATED APPLICATION

This non-provisional patent application claim priority to the provisional patent application having Ser. No. 61/966,651, filed on Feb. 27, 2014.

FIELD OF THE DISCLOSURE

This disclosure generally relates to a cover for a bottle for containing a liquid and more particularly to a leakproof cover for a container for liquids that incorporates fully and continuous venting.

BACKGROUND

Frequently, individuals use containers having closures or caps, for sports drinks and other liquids, as well as various solids. Containers are needed to hold any liquid or solid that is used immediately and as well as thereafter. Containers having a reusable closure device are used to maintain hygienic conditions around any pouring and drinking surfaces. Some container closures require a cover to seal the closure or container to prevent discharge of the liquid or solid from the container when it is not desirable. One type of container closure is the typical solid type, which is normally attached to the container by a twisting of the mating screw threads on both the closure and the container. The closure is then removed by unscrewing it and pouring out the desired portion of the contents from the container. A commonly used closure for containers utilized during participation in sports also has mating screw threads on the container and the closure, but additionally the spout associated with the sports bottle is resealable. One type of resealable spout is a pop-up spout which when pushed up allows fluid from within the container to flow for drinking. Another form of closure utilizes a spout with an extension to the periphery of the spout, so that the spout is not touched during opening and closing of the container. Any closure and spout configuration may utilize a protective cover in order to attempt to minimize contamination of the spout portion.

Known containers and closures and their variations are present in both disposable and reusable forms. Disposable containers tend to utilize the closure commonly present on soft drink and water containers, which are the type removed by twisting mating threads present on both the container and the closure. With these types of containers, spouts are not typically utilized.

Contamination of the spout of the container is an ever increasing problem. Both the frequency and the degree of contamination are increasingly present. Cross contamination may occur if one or more individuals accidentally use another individual's container or bottle, especially if one or more of the users have a known or unknown infection. Frequently, a user with an illness is not aware of the illness, especially in the early stages of the illness. Compounding this problem, the microorganisms responsible for contamination are demonstrating more resistance.

A common practice to cleanse the spout is to use soap and water. Due to the inaccessibility to the interior of a large number of spouts, cleansing may not be possible. Also, especially with increasing debris and increasing microbacterial contamination with repeated use, attempts at cleansing may be less efficient and more pathological organisms are present. The increasing number of parts and increasing inaccessible aspects of the parts leads to increasing contamination.

One significant disadvantage of not obtaining adequate cleaning of the container is pathological growth of bacteria, which may consist of resistant organisms. The user ingests these pathological and disease producing organisms at an alarming and increasing rate. The result is a higher incidence of disease. The disease may be localized in the gastrointestinal tract or may gain entry into the blood stream and permeate into any other organ system. Access to any organ system can lead to significant mortality, especially in younger individuals who are more susceptible to infections. Medication and hospitalization are sometimes needed for infection from these microorganisms. Also, of note, is that individuals, especially infants and children, after experiencing significant illness, are hesitant and frequently extremely anxious and afraid to go to a medical provider's office for any type of care. Even if the care involves no discomfort at all, the individual will be reluctant to seek medical attention.

It is also known that a vacuum forms in a container when the contents are removed, unless the container is vented. Most containers are not vented, and even if vented, the contents of the container are contaminated as air enters the container through the liquid. To achieve automatic and complete venting without contaminating the liquid stored in a container, it is known to use an insert sifting superior to the container and a vertical venting tube containing a reservoir. As the contents of the prior art containers are removed, a vacuum forms in an unvented container, which is known to slow or even stop, the flow of the contents from the container. Furthermore, if a container does provide continuous venting, such as a container having a vent in the top of the container separate from the pouring aperture, the rapid flow of the contents from the spout of the container, even with a small venting aperture, can exceed the desired amount. Air is also typically introduced into the liquid when using known containers. Applicant's assignee has attained U.S. Pat. Nos. 5,779,071 and 5,570,796 on vented nursing bottles.

Air enters the container to relieve the vacuum and allow for more of the contents to exit the container. Before air enters the container to relieve the vacuum in the prior art container, the vacuum pressure must elevate significantly, and sometimes even open a check valve. This prevents easy elimination of the vacuum and prevents release of the contents. Also, as air eventually enters the container, it mixes with and contaminates the contents in the container. The mixing of the container contents and air causes aeration of the contents. This mixing can lead to degradation of the contents of the container. For example, if the contents are a fruit drink or juice, then the vitamin C in the juice may degrade due to being mixed with air. The taste of the contents may also detrimentally suffer. This is especially detrimental concerning the carefully monitored flavor of wine.

In order to prevent air from contaminating the contents of a container, it is known by the applicant herein to provide a closure having a vent aperture associated with a reservoir connected to the vent aperture and a spout for allowing liquid to flow through the spout. The vent prevents the creation of a vacuum inside the container. See previously identified patents. This also prevents the introduction of air into the liquid stored in the container when poured to prevent oxidation. Although this vent device is useful, there is no way to prevent contamination of the spout.

The present disclosure is designed to obviate and overcome many of the disadvantages and shortcomings experienced with prior containers. The present disclosure is related to a leakproof cover for combined pouring and venting container closure. It would be desirable and advantageous to have a leakproof cover that is easy to clean. Further, it would be advantageous to having a leakproof cover for a spout.

SUMMARY OF THE DISCLOSURE

In one form of the present disclosure, a leakproof cover for combined pouring and venting container closure is disclosed, which comprises a cap having an outer surface and an inner surface, a first arm having an aperture, a latch, a projection, a stop member extending downwardly from the inner surface, and a second arm extending downwardly from the inner surface with the second arm having an aperture, a closure device having a threaded rim, a vent, a partially single or double venting spout; a pair of arms each having an aperture therein, a first pin for insertion through the apertures in the pair of arms and the aperture in the first arm of the cap for connecting the cap to the closure device, a spout seal device having a pair of arms each having an aperture, an upper member having a pair of depending legs with the upper member and the legs for covering the spout, the upper member having a rubber insert that provides a seal between the spout and the spout seal device to prevent any liquid from leaking out of the spout, and a second pin for insertion through the apertures in the pair of arms of the spout seal device and the aperture in the second arm for connecting the spout seal device to the cap.

In another form of the present disclosure, a leakproof cover for a pouring container closure is disclosed which comprises a cap having an outer surface and an inner surface, a first arm having an aperture, a latch, a projection, a stop member extending downwardly from the inner surface, and a second arm extending downwardly from the inner surface with the second arm having an aperture, a closure device having a threaded rim, a spout; a pair of arms each having an aperture therein, a first pin for insertion through the apertures in the pair of arms and the aperture in the first arm of the cap for connecting the cap to the closure device, a spout seal device having a pair of arms each having an aperture, an upper member having a pair of depending legs with the upper member and the legs for covering the spout, the upper member having a rubber insert that provides a seal between the spout and the spout seal device to prevent any liquid from leaking out of the spout, and a second pin for insertion through the apertures in the pair of arms of the spout seal device and the aperture in the second arm for connecting the spout seal device to the cap.

In light of the foregoing comments, it will be recognized that the present disclosure provides a leakproof cover for combined pouring and venting container closure.

The present disclosure is also directed to a leakproof cover for a pouring container closure.

The present disclosure provides a leakproof cover for combined pouring and venting container closure that can be easily employed with highly reliable results.

The present disclosure also provides a leakproof cover for combined pouring and venting container closure which is economical and simple to manufacture, which is convenient and easy to use, and which eliminates the generation of any vacuum that occurs when using the leakproof cover.

The present disclosure provides a leakproof cover for combined pouring and venting container closure that utilizes parts that are easily assembled, and very easily disassembled.

The present disclosure provides a leakproof cover for combined pouring and venting container closure that utilizes parts that can be very easily and thoroughly cleaned.

The present disclosure also provides a leakproof cover for combined pouring and venting container closure that minimizes the number of parts that are required in an assembly, thereby reducing the incidence of loss of any components.

The present disclosure is further directed to a leakproof cover for combined pouring and venting container closure that is used in conjunction with a container that provides fully and continuously vented drinking, and which eliminates the generation of any vacuum therein, during usage and application.

These and other advantages of the present disclosure will become apparent to those skilled in the art after considering the following detailed specification in conjunction with the accompanying drawings.

DETAILED DESCRIPTION OF PREFERRED EMBODIMENTS

Figure 1:
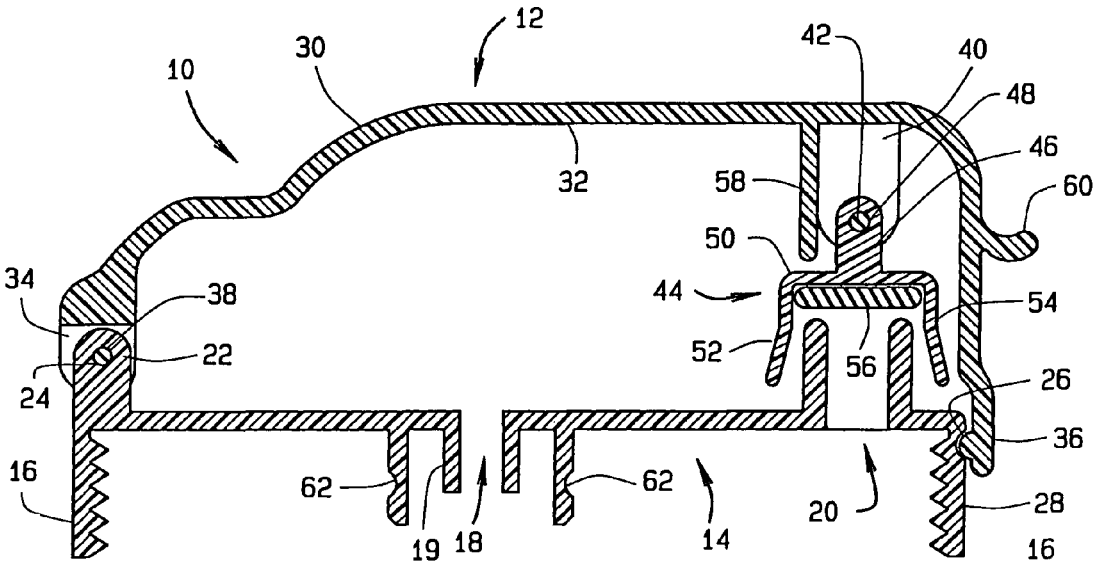
FIG. 1 is a cross-sectional view of a leakproof cover for combination pouring and venting container closure constructed according to the present disclosure.

Referring now to the drawings, wherein like numbers refer to like items, number 10 identifies a preferred embodiment of a leakproof cover for a combined pouring and venting container closure constructed according to the present disclosure. With reference now to FIG. 1, the cover 10 comprises a cap 12 that is connected to a closure device 14. The cap 12 may cover and seal the closure device 14 and may uncover the closure device 14. The closure device 14 has a threaded collar or rim 16 that may be threaded to a container (not shown) for holding or storing a liquid that has a threaded opening for receiving closure device 14. The threaded rim 16 has a vent 18 and a spout 20, both of which are integrally formed therein. The vent 18 prevents any air from entering into the container to contaminate any liquid being stored in the container. The spout 20 provides an output for any liquid stored in the container to be delivered to a user of the cover 10. The closure device 14 also has an arm 22 having an aperture 24. Although one arm 22 is shown in this particular view, it is contemplated that a pair of arms 22 may be integrally formed with the closure device 14. Also, the other arm 22 has an aperture 24. The closure device 14 has an indentation 26 formed on an exterior surface 28. It is likely in order to provide for complete venting of any vacuum that generates within any container to which this closure is applied, that the form of venting, or double venting structure, as shown in our U.S. Pat. No. 5,779,071, could be connected with the vent structure 18, that allows for entrance of air into the bottom of the container, in the manner as described in said previous patent, but at the same time, does not allow leakage of any of the liquid contents from the container through this identified venting structure 18, or the internal vent 19, as mentioned in U.S. Pat. No. 5,779,071, that prevents egress of fluid from the container.

The cap 12 has an outer surface 30, an inner surface 32, an arm 34, and a latch 36. Although not shown, the arm 34 has an aperture that is adjacent to the aperture 24 formed in the arm 22. A pin 38 inserted through the aperture 24 is used to connect the arms 22 and 34 together. This also connects the cap 12 to the closure device 14. In this manner, the cap 12 is able to rotate, pivot, or open and close relative to the closure device 14. Again, although not shown, it is possible that the pin 38 is inserted through the aperture associated with the arm 34. Also, when a pair of arms 22 are part of the closure device 14, the pin 38 is inserted through the aperture formed in the other arm. Again, in this manner, the cap 12 is connected to the closure device 14.

The inner surface 32 has an arm 40 having an aperture (not shown) through which is inserted a pin 42. A spout seal device 44 has a pair of upper arms 46, although only one of the arms 46 is shown, that each have an aperture 48 through which the pin 42 is inserted. The pin 42 connects the spout seal device 44 to the arm 40. Also, the pin 42 allows the spout seal device 44 to move, swivel, or pivot relative to the arm 40. The spout seal device 44 has an upper member 50 having a depending cover shown at 52 and 54. The upper member 50 and the cover 52 and 54 are used to cover the spout 20 when the cap 12 is in the closed position. The upper member 50 has a rubber insert 56 that provides a seal between the spout 20 and the spout seal device 44 to prevent any liquid from leaking out of the spout 20 when the cap 12 is in the closed position.

A stop member 58 depends downwardly from the inner surface 32. The stop member 58 is used to restrict or prevent the spout seal device 44 from pivoting away from the spout 20 and ensures that the spout seal device 44 will seal against the spout 20. The outer surface 30 of the cap 12 has a projection 60 that is used to release the latch 36 from the indentation 26 to move the cap 12 to the open position. The projection 60 may also be used to assist in moving the cap 12 into the closed position.

The cap 12 is shown as being in the closed position. As can be appreciated, in the closed position, the rubber insert 56 seals against the spout 20 and liquid is prevented from leaving through the spout 20. The spout seal device 44 surrounds the spout 20 and the stop member 58 orientates the device 44 over the spout 20. In order to move the cap 12 to the open position, the projection 60 is pressed against to release the latch 36 away from the indentation 26. The cap 12 is further moved to release the rubber insert 56 and the device 44 away from the spout 20. The cap 12 will then be moved or swiveled away from the closure device 14 to allow access to the spout 20 and to allow the vent 18 to function. The pin 38 keeps the cap 12 secured to the closure device 14. The vent 18 also has an indentation 62 that is used to hold a reservoir attachment (not shown) in place. When the cap 12 needs to be placed in the closed position, the projection 60 may be used to reposition the cap 12 over the closure device 14. Again, in the closed position, the rubber insert 56 will be sealed in place against the spout 20.

Figure 2:
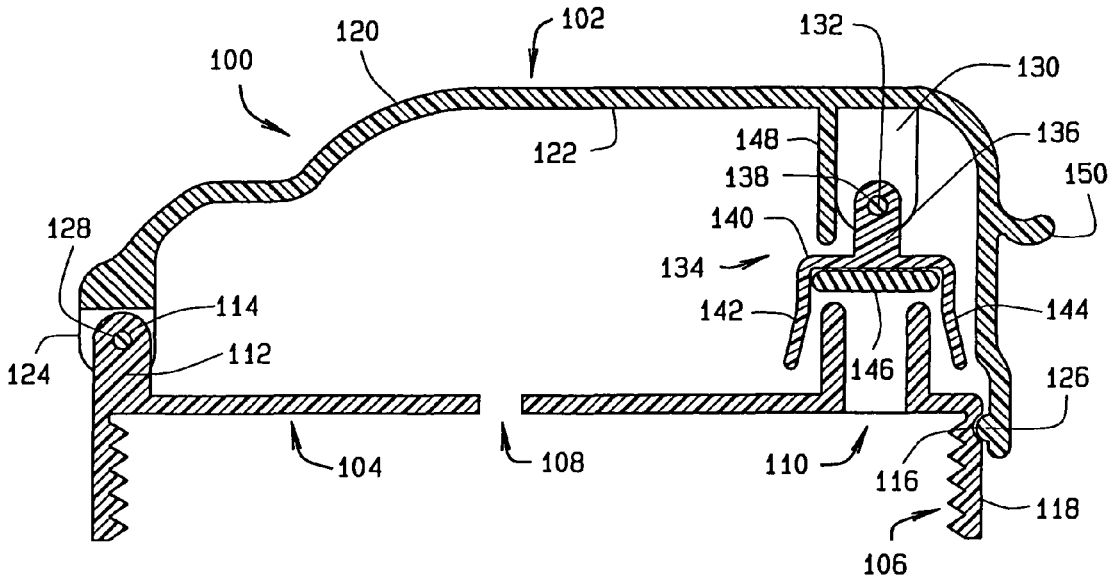
FIG. 2 is a cross-sectional view of a leakproof cover for combination pouring and venting container closure constructed according to the present disclosure being used to cover another combination pouring and venting container closure associated with a container.

With reference now to FIG. 2, another embodiment of a leakproof cover for a combined pouring and venting container cover 100 is shown. The cover 100 comprises a cap 102 that is connected to a closure device 104. The cap 102 may cover and seal the closure device 104 and may uncover the closure device 104. The closure device 104 has a threaded collar or rim 106 that may be threaded to a container (not shown) for holding or storing a liquid that has a threaded opening for receiving closure device 104. The threaded rim 106 has a vent 108 and a spout 110, both of which are integrally formed therein. The vent 108 prevents any air from entering into the container to contaminate any liquid being stored in the container. A main difference between the cover 10 and the cover 100 is that the vent 108 is different than the vent 18. The spout 110 provides an output for any liquid stored in the container to be delivered to a user of the cover 100. Once again, the type of double venting structure shown in our U.S. Pat. No. 5,779,071 could connect with the vent 108, through the addition of one or more optional flanges associated with the closure device 104, in order to furnish a venting of any generated vacuum within the container, as it is inverted, and eliminate the need for any air or bubbles to flow through the liquid, during its consumption. The closure device 104 also has a pair of arms 112 each having an aperture 114. Only one of the arms 112 and one of the apertures 114 are shown in this particular view. The closure device 104 has an indentation 116 formed on an exterior surface 118.

The cap 102 has an outer surface 120, an inner surface 122, an arm 124, and a latch 126. Although not shown, the arm 124 has an aperture that is adjacent to the apertures 114 formed in the arms 112. A pin 128 inserted through the apertures 114 of the arms 112 and the aperture in the arm 124 is used to connect the arms 112 and 124 together. This also connects the cap 102 to the closure device 104. In this manner, the cap 102 is able to rotate, pivot, or open and close relative to the closure device 104.

The inner surface 122 has an arm 130 having an aperture (not shown) through which is inserted a pin 132. A spout seal device 134 has a pair of upper arms 136, although only one of the arms 136 is shown, that each have an aperture 138 through which the pin 132 is inserted. The pin 132 connects the spout seal device 134 to the arm 130. Also, the pin 132 allows the spout seal device 134 to move, swivel, or pivot relative to the arm 130. The spout seal device 134 has an upper member 140 having a depending cover shown at 142 and 144. The upper member 140 and the cover 142 and 144 are used to cover the spout 110 when the cap 102 is in the closed position. The upper member 140 has a rubber insert 146 that provides a seal between the spout 110 and the spout seal device 134 to prevent any liquid from leaking out of the spout 110 when the cover 100 is in the closed position. A stop member 148 depends downwardly from the inner surface 122. The stop member 148 is used to prevent the spout seal device 134 from pivoting away from the spout 110 and ensures that the spout seal device 134 will seal against the spout 110. The outer surface 120 of the cap 102 has a projection 150 that is used to release the latch 126 from the indentation 116 to move the cap 102 to the open position. The projection 150 may also be used to assist in moving the cap 102 into the closed position.

Figure 3:
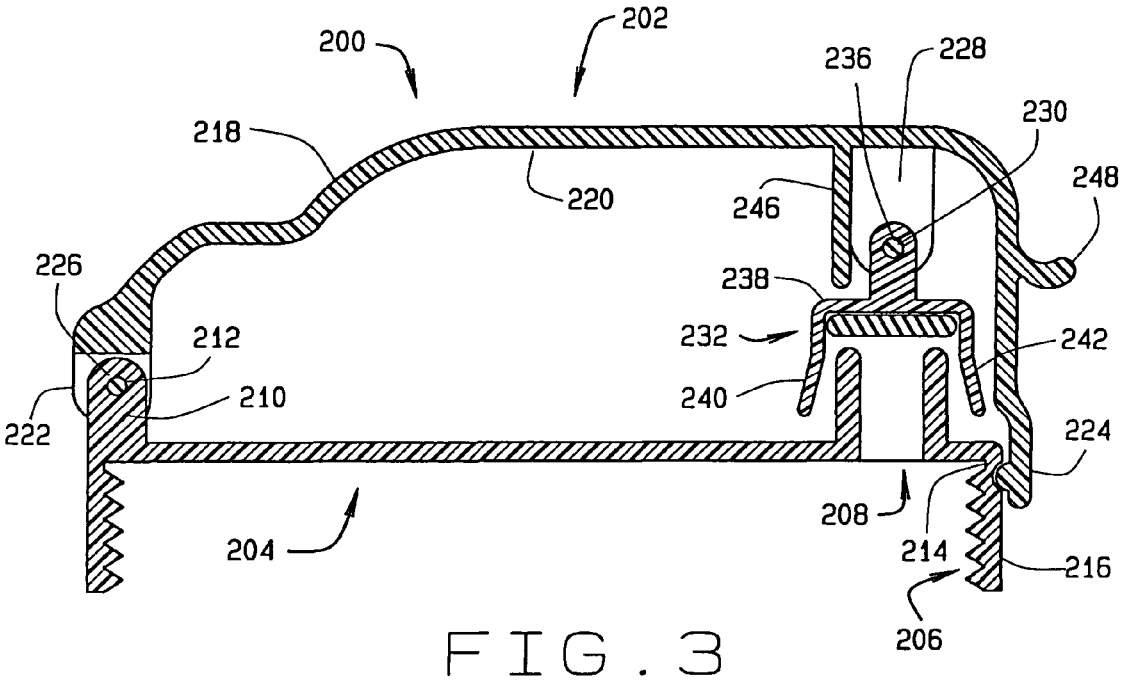
FIG. 3 is a cross-sectional view of a leakproof cover for combination pouring and venting container closure constructed according to the present disclosure being used to cover another combination pouring and venting container closure associated with a container.

FIG. 3 illustrates an embodiment of a leakproof cover for a container cover 200. A major different between the cover 200 and the covers 10 and 100 is that there is no venting provided. The cover 200 comprises a cap 202 that is connected to a closure device 204. The cap 202 is used to cover and seal the closure device 204 and to uncover the closure device 204. The closure device 204 has a threaded collar or rim 206 that may be threaded to a container (not shown) for holding or storing a liquid that has a threaded opening for receiving closure device 204. The threaded rim 206 has a spout 208 that is integrally formed therein. The spout 208 is used to pour or sip any liquid stored in the container to be delivered to a user of the cover 200. The closure device 204 also has a pair of arms 210 each having an aperture 212. Only one of the arms 210 and one of the apertures 212 are shown in this particular view. The closure device 204 has an indentation 214 formed on an exterior surface 216.

The cap 202 has an outer surface 218, an inner surface 220, an arm 222, and a latch 224. Although not shown, the arm 222 has an aperture that is adjacent to the apertures 212 formed in the arms 210. A pin 226 is inserted through the apertures 212 formed in the arms 210 and the aperture in the arm 222 and is used to connect the arms 210 and 222 together. This also connects the cap 202 to the closure device 204. In this manner, the cap 202 is able to rotate, pivot, or open and closed relative to the closure device 204.

The inner surface 220 has an arm 228 that has an aperture (not shown) formed therein through which is inserted a pin 230. A spout seal device 232 has a pair of upper arms 234, although only one of the arms 234 is visible, that each have an aperture 236 through which the pin 230 is inserted. The pin 230 is used to connect the spout seal device 232 to the arm 228. Also, the pin 230 allows the spout seal device 232 to move, swivel, or pivot relative to the arm 228. The spout seal device 232 has an upper member 238 having a depending cover shown at 240 and 242. The upper member 238 and the cover 240 and 242 are used to cover the spout 208 when the closure cap 202 is in the closed position. The upper member 238 has a rubber insert 244 that provides a seal between the spout 208 and the spout seal device 232 to prevent any liquid from leaking out of the spout 208 when the cap 202 is in the closed position. A stop member 246 depends downwardly from the inner surface 220. The stop member 246 is used to prevent the spout seal device 232 from pivoting away from the spout 208 and ensures that the spout seal device 232 will seal against the spout 208. The outer surface 218 of the cap 202 has a projection 248 that is used to release the latch 224 from the indentation 214 to move the cap 202 to the open position. The projection 248 may also be used to assist in moving the cap 202 into the closed position.

The cap 202 is depicted as being in the closed position. When the cap 202 is in the closed position, the rubber insert 244 seals against the spout 208 to provide a leakproof seal. The spout seal device 232 surrounds the spout 208 and the stop member 246 positions the device 232 over the spout 208. In order to move the cap 202 to the open position, the projection 246 is pressed against to release the latch 224 away from the indentation 214. The cap 202 is further moved to release the rubber insert 244 and the device 232 away from the spout 208. The cap 202 will then be moved or swiveled away from the closure device 204 to allow access to the spout 208. The pin 212 keeps the cap 202 secured to the closure device 204. When the cap 202 needs to be placed in the closed position, the projection 248 may be used to reposition the cap 202 over the closure device 204. Again, in the closed position, the rubber insert 244 will be sealed in place against the spout 208. The cover 200 may be used on any threaded container to provide a leakproof cover for keeping liquid in the container when not in use.

From all that has been said, it will be clear that there has thus been shown and described herein a leakproof cover for a combined pouring and venting container closure. It will become apparent to those skilled in the art, however, that many changes, modifications, variations, and other uses and applications of the subject leakproof cover for a combined pouring and venting container closure are possible and contemplated. All changes, modifications, variations, and other uses and applications which do not depart from the spirit and scope of the invention are deemed to be covered by the disclosure, which is limited only by the claims which follow.

I claim:

1. A leakproof cover for combined pouring and venting container closure comprising:
   - a cap having an outer surface and an inner surface, a first arm having an aperture, a latch, a projection, a stop member extending downwardly from the inner surface, and a second arm extending downwardly from the inner surface with the second arm having an aperture;
   - a closure device having a threaded rim, a vent, a spout; a pair of arms each having an aperture therein;
   - a first pin for insertion through the apertures in the pair of arms and the aperture in the first arm of the cap for pivotally connecting the cap to the closure device;
   - a spout seal device having at least one arm having an aperture, an upper member forming a cover with the upper member for covering the spout, the upper member having a rubber insert within its cover that provides a seal between the spout and the spout seal device to prevent any liquid from leaking out of the spout; and
   - a second pin for insertion through the apertures in the arm of the spout seal device and the aperture in the second arm for connecting the spout seal device to the cap.

2. The leakproof cover for combined pouring and venting container closure of claim 1 wherein the closure device further comprises an exterior surface having an indentation into which the latch fits.

3. The leakproof cover for combined pouring and venting container closure of claim 1 wherein the cap can be moved into an open position where the spout seal device is away from the spout.

4. The leakproof cover for combined pouring and venting container closure of claim 1 wherein the cap can be moved into a closed position where the spout seal device covers the spout.

5. The leakproof cover for combined pouring and venting container closure of claim 1 wherein the stop member contacts the upper member to restrict movement of the spout seal device.

6. The leakproof cover for combined pouring and venting container closure of claim 1 wherein the cap can be rotated in an open position in which the spout seal device is moved away from the spout to allow access to the spout and the cap can be rotated in a closed position in which the rubber insert seals against the spout.

7. The leakproof cover for combined pouring and venting container closure of claim 1 wherein the closure device is adapted to be threaded onto a threaded container.

8. A leakproof cover for a pouring container closure comprising:
   - a cap having an outer surface and an inner surface, a first arm having an aperture, a latch, a projection, a stop member extending downwardly from the inner surface, and a second arm extending downwardly from the inner surface with the second arm having an aperture;
   - a closure device having a threaded rim, a spout; a pair of arms each having an aperture therein;
   - a first pin for insertion through the apertures in the pair of arms and the aperture in the first arm of the cap for connecting the cap to the closure device;
   - a spout seal device having a pair of arms each having an aperture, an upper member having a depending cover with the upper member and its cover for covering the spout, the upper member having a rubber insert that provides a seal between the spout and the spout seal device to prevent any liquid from leaking out of the spout; and a second pin for insertion through the apertures in the pair of arms of the spout seal device and the aperture in the second arm for connecting the spout seal device to the cap.

9. The leakproof cover for a pouring container closure of claim 8 wherein the closure device further comprises an exterior surface having an indentation into which the latch fits.

10. The leakproof cover for a pouring container closure of claim 8 wherein the cap can be moved into an open position where the spout seal device is away from the spout.

11. The leakproof cover for a pouring container closure of claim 8 wherein the cap can be moved into a closed position where the spout seal device covers the spout.

12. The leakproof cover for a pouring container closure of claim 8 wherein the stop member contacts the upper member to restrict movement of the spout seal device.

13. The leakproof cover for a pouring container closure of claim 8 wherein the cap can be rotated in an open position in which the spout seal device is moved away from the spout to allow access to the spout and the cap can be pivoted in a closed position in which the rubber insert seals against the spout.

14. The leakproof cover for a pouring container closure of claim 8 wherein the closure device is adapted to be threaded onto a threaded container.

15. The leakproof cover for a pouring container closure of claim 14, wherein closure having a vent provided therethrough, and a venting structure connecting at the closure vent opening to provide for entrance of air into the associated container when it is inverted for consumption of its contents.

16. The leakproof cover for a pouring container of claim 15, wherein said venting structure is a double vented structure, including a vent tube, said vent tube locating within a reservoir, and a reservoir tube extending to the bottom of the container to allow for entrance of air during consumption of the container liquid contents.

* * * * *